United States Patent [19]

Ishii

[11] 3,965,818

[45] June 29, 1976

[54] PRESSURE CONTROL DEVICE FOR OFFSET PRINTING MACHINE

[75] Inventor: Koji Ishii, Fukuyama, Japan

[73] Assignee: Ryobi, Ltd., Hiroshima, Japan

[22] Filed: Mar. 28, 1975

[21] Appl. No.: 563,166

[30] Foreign Application Priority Data

Mar. 28, 1974 Japan ..... 49-35726[U]

[52] U.S. Cl. ..... 101/218

[51] Int. Cl.[2] ..... B41F 7/06; B41F 13/28

[58] Field of Search ..... 101/137, 139, 140, 143, 101/144, 145, 184, 217, 218, 247; 74/567

[56] References Cited

UNITED STATES PATENTS

| | | | |
|---|---|---|---|
| 1,979,195 | 10/1934 | Govare et al. | 74/567 X |
| 2,220,255 | 11/1940 | Marchev et al. | 101/145 |
| 2,860,577 | 11/1958 | Fowlie | 101/218 |
| 3,431,843 | 3/1969 | Kaneko et al. | 101/218 |
| 3,601,045 | 8/1971 | Schinke | 101/144 |

*Primary Examiner*—J. Reed Fisher

[57] ABSTRACT

A pressure control device for offset printing machines, having a cam shaft mounted between a pair of side plates, a dial provided at one end of the shaft, cam plates rotating with the dial in a single body having spiral cam slot surfaces. The cam slots are engaged with pins mounted on two arms supporting a pressure cylinder, and have one end formed to latch the pin in an escape position. With the above device, even during the operation of a printing machine, the pressure of the pressure cylinder to printing paper can be adjusted simply by the dial control, and an automatic adjustment can further be possible when the dial is set at AUTO position and the pins are in the escape positions.

7 Claims, 7 Drawing Figures

PRESSURE CONTROL DEVICE FOR OFFSET PRINTING MACHINE

BACKGROUND OF THE INVENTION

This invention relates to a pressure control device for offset printing machines, and more particular to an improved device for adjusting the printing pressure of a pressure cylinder to printing paper.

In conventional offset printing machine, the printing control for the thickness of printing paper has been done by the rotation of nuts and double nuts fixed to shafts onto which springs for elastically pressing a pressure cylinder to a rubber bracket are provided. However, this manner of adjustment is only possible with the printing machine in a pause mode, and moreover requires some tools. Thus, adjustment has taken considerable time and is tedious.

Therefore, an object of the invention is to provide an improved device which is capable of adjusting the pressure even while a printing machine is in operation as well as in the pause mode.

Another object of the invention is to provide an improved device which is capable of adjusting the pressure corresponding to the paper thickness just by the rotation of an adjustor dial without any tools.

It is a still further object of the invention to provide a pressure control device which automatically adjusts the pressure for thin paper or ordinary thickness paper irrespective of some variation in the thickness.

The above and other objects and the advantages of the invention will be apparent from the description taken in conjunction with the accompanying drawings.

DETAILED DESCRIPTION OF A PREFERRED EMBODIMENT

Figure 1:
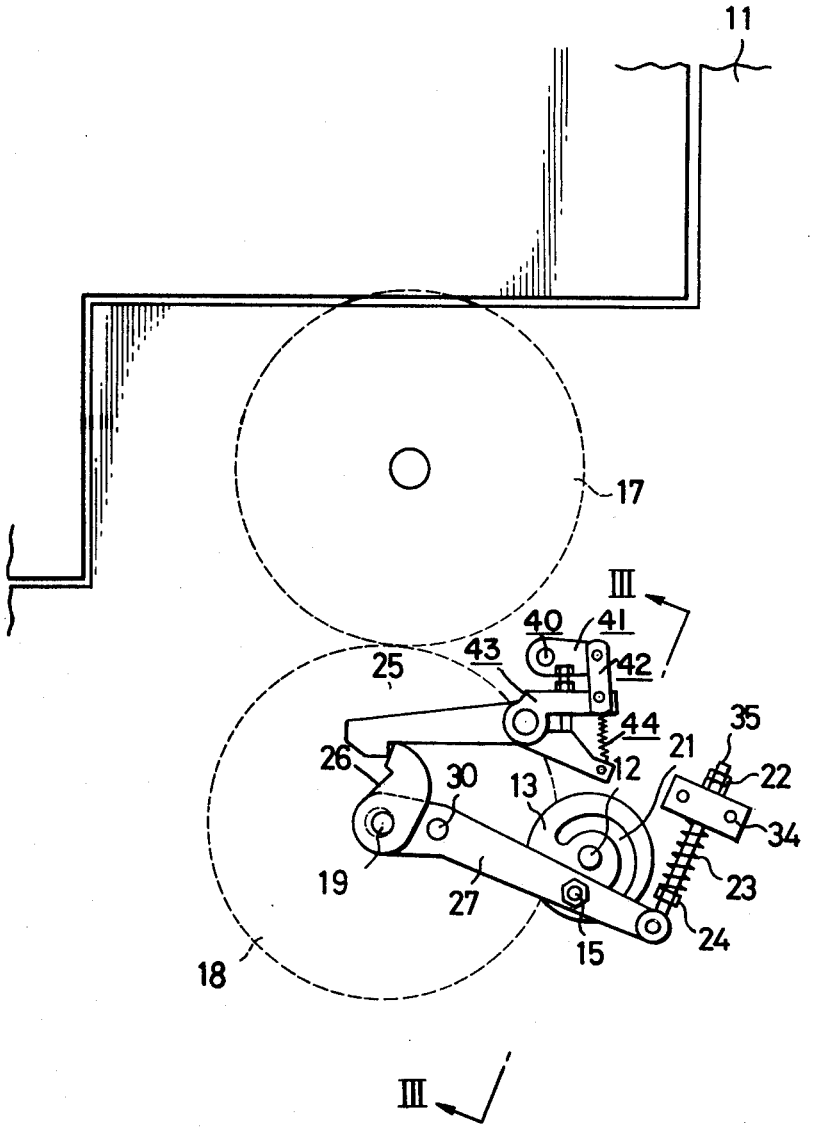
FIG. 1 is a side view of an offset printing machine incorporating an embodiment of the invention seen from an operator side, which represents the state that a pin is engaged with a pin escape portion of a cam slot to effect automatic pressure control.
Figure 2:
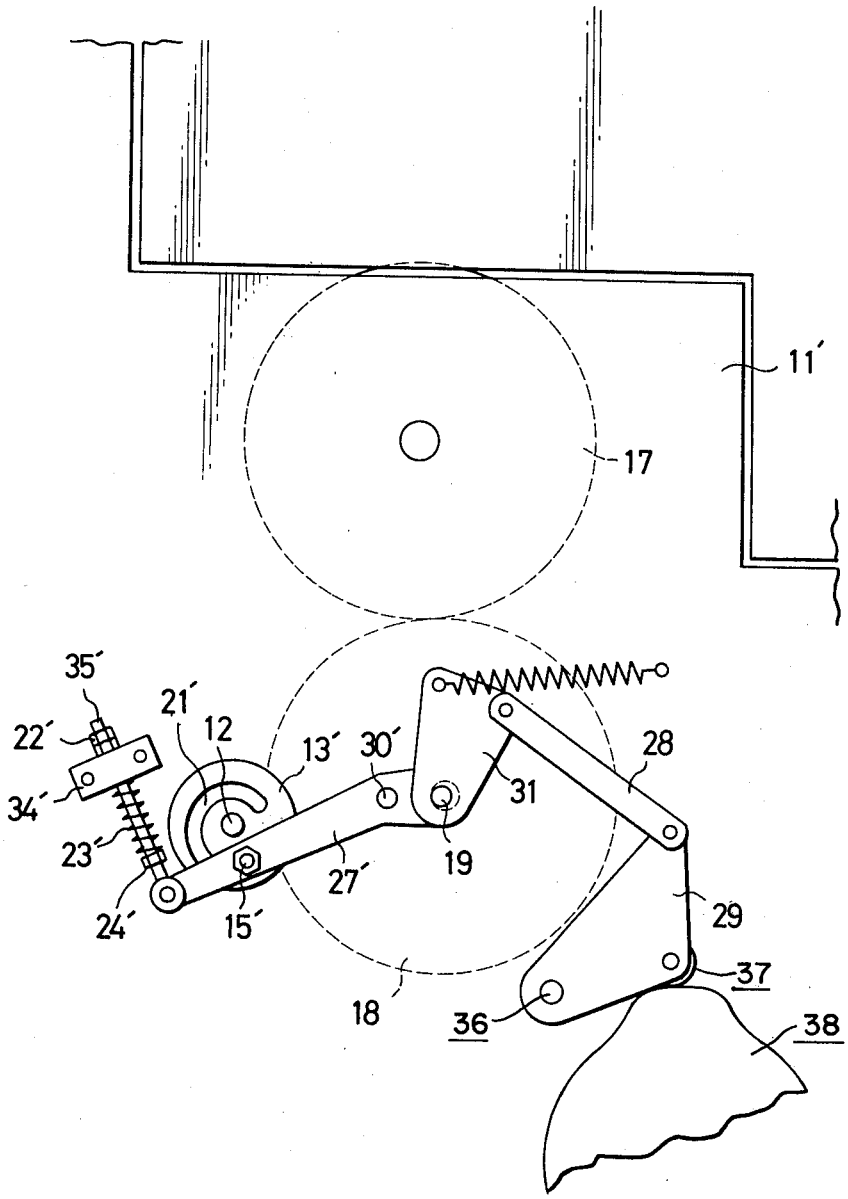
FIG. 2 is a side view of the printing machine of FIG. 1 as seen from the opposite side.

In FIGS. 1 and 2, a pressure cylinder 18 is supported by an eccentric shaft 19, and arranged to be separable from a rubber roller or blanket cylinder 17 by means of a pressure cylinder separating means (not shown) through an arm 31 fixed to one end of the eccentric shaft 19 and a link 28 and a cam lever 29 sequentially coupled with the arm. The other end of the eccentric shaft 19 is fixedly provided with a lever 26 which is engaged with a ratch 25 to keep the contact state to enable the printing when the pressure cylinder 18 is contacted to the rubber roller 17.

As shown in FIG. 2, a cam 38 is rotated by the drive motor at the same rotation as the blanket cylinder 17 and impression cylinder 18. The cam lever 29 is swingably pivoted at 36 and has a roller 37 being in contact with the cam 38. When the cam lever 29 is pressed up by a protuberance of the cam 38 through the roller 37, the arm 31 is turned counterclockwise through the link 28 thereby to rotate the shaft cylinder 18. Since the arm 31 is fixed to the eccentric portion 19 of the shaft of cylinder 18, the cylinder comes into contact with the blanket cylinder 17 due to the above movement of the arm 31. When the cam lever 29 goes down by further rotation of the cam 38, the arm 31 is now turned clockwise. As mentioned above, since the cam 38 is rotated by the drive motor, this rocking movement of the arm 31 is continued when the main switch is in the state of ON. Therefore, the contact and separation of the cylinder 18 in respect of the cylinder 17 is repeated again and again during the operation of the printing machine, insofar as no paper feed is made.

Since the lever 26 is also fixed to the shaft of cylinder 18 at the other end opposite to the one end fixed with arm 31, the lever 26 turns clockwise whenever the protuberance of cam 38 cause the shaft of cylinder 18 to rotate counter-clockwise (FIG. 1) thereby to urge the impression cylinder 18 toward the blanket cylinder 17 to come into contact therewith.

As shown in amended FIG. 1, the latch 25 goes down to closely approach the lever 26 by clockwise rotation of a shaft 40, through arm 41, link 42, lever 43 and spring 44 which are numbered in the amended drawing. The shaft 40 rotates clockwise and counterclockwise in the same manner as the impression cylinder shaft by an unshown cam which moves in the same rotation as the cylinders, like cam 38, through unshown lever, link and arm. This shaft 40 is fixedly provided with a feelerfinger (not shown) which swings vertically and is adapted to perceive the existence of paper fed, by abutting against the paper.

Then, when the paper feed is made to come into the printing operation, the tip of the feelerfinger abuts against a paper fed and is prevented from the descent movement thereof. Since the feelerfinger is fixed to the shaft 40, such obstruction of the descent movement of the feelerfinger tip prevents in turn the shaft 40 from rotating clockwise so that the latch 25 is maintained down so as to engage with the lever 26 thereby keeping the contact state of the impression cylinder 18 with the blanket cylinder 17.

However, when the paper feed is not made, since the feelerfinger is not prevented from its descent movement, shaft 40 continues its rotational movement to make the latch 25 going up thereby to go away from the lever 26. This rotation of the shaft 40 is caused by further rotation of the aforementioned unshown cam.

Rotatably fixed to both ends of the pressure cylinder eccentric shaft 19 are one end of each of the arms 27, 27′. The arms 27, 27′ are rockingly pivoted on the fulcrum of pins 30, 30′ at the proximity of their one ends, and provided with pins 15, 15′ near the other ends. These other ends of the arms 27, 27′ are energized with compression springs 23, 23′ for elastically pressing the pressure cylinder 18 to the rubber roller 17 through the arms. The springs 23, 23′ are fit onto shafts 35, 35′ supported on blocks 34, 34′ fixed on side plates 11, 11′, and are interposed between the blocks and nuts 24, 24′ screwed to the shafts. The nuts 24, 24′ are provided for adjusting the contact pressure between the cylinder 18 and the rubber roller 17. Double nuts 22, 22′ are screwed to the ends of the shafts 35, 35′ projecting outside of the blocks 34, 34′. These double nuts function to adjust the approaching position of the cylinder 18 to the rubber roller 17.

Figure 3:
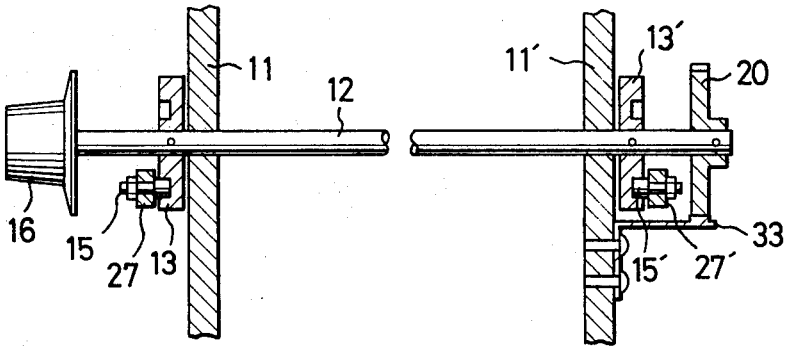
FIG. 3 is a cross sectional view of a partially broken essential part taken along the line III—III of FIG. 1.

As shown in FIG. 3, the side plates 11, 11′ are provided therebetween with a cam shaft 12 fitted with a dial 16 on one end and a positioning wheel 20 on the other end. The cam shaft 12 is fitted with cam plates 13, 13' thereon at the end portions projecting out of the side plates 11, 11'. The cam plates 13, 13' may have grooves, slots, recesses or elongated openings therein, the inner side surfaces of which define cam surfaces. On the cam surfaces, the pins 15, 15' mounted on the arms 27, 27' are elastically pressed by means of the springs 23, 23'.

Figure 4:
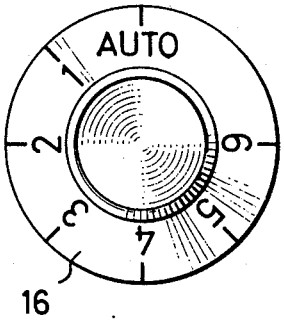
FIG. 4 is a front view of a dial.
Figure 5:
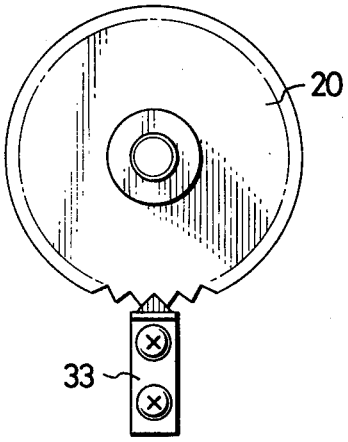
FIG. 5 is a front view of a positioning wheel.

As shown in FIG. 4, the dial 16 is provided with the letter "AUTO" and the numerals 1, 2, 3, 4, 5 and 6 as a graduation. As seen in FIG. 5, the positioning wheel 20 is provided with a serration. Engaging with a click 33, the serration forms a positioning mechanism to prevent the displacement of pressure adjusted position due to unexpected rotation of the cams 13, 13' during the printing operation.

Figure 6:
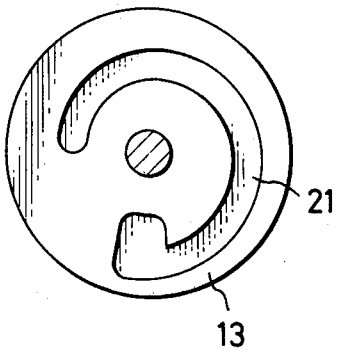
FIGS. 6 and 7 are enlarged front views of a cam.
Figure 7:
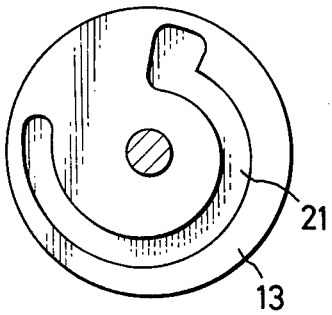

As clearly shown in FIGS. 6 and 7, the cam surfaces mounted on the cam plates 13, 13' are formed in so-called spiral form, that is, the distances from the cam shaft 12 to the both ends of the cam slot are made different. FIG. 6 shows an embodiment of the cam plate where the cam shaft 12 is arranged above the arms 27, 27'. In this embodiment, escape positions for the pins 15, 15' are formed at the terminal ends of the cam surfaces, which is most distant from the cam shaft, the cam surfaces continuing toward the cam shaft. FIG. 7 indicates an embodiment of the cam plate where the cam shaft 12 is arranged below the arms 27, 27'. In this embodiment, the escape positions for the pins 15, 15' are formed at the terminal end of the cam slot nearest to the cam shaft, the cam slot continuing in a direction away from the cam shaft. The plates 13, 13' are so provided on the cam shaft that the terminal ends of the cam slots having the pin escape portions correspond to the "AUTO" position of the dial, while the other terminal ends correspond to the graduation 6.

The operation of the device according to the invention will now be described. When a printing paper is fed, the pressure cylinder 18 and the rubber roller 17 which are rotated by a suitable drive source at the same rotary frequency are made to continue the rotation in contacting each other to provide a "printing available" condition by the engagement of the ratch 25 and the lever 26. Firstly, if the paper thickness is thin or ordinary, or a non-uniform print is not especially required, the dial 16 is set at the AUTO position. Then, the pins 15, 15' of the arms 27, 27' are elastically pressed, by means of the springs 23, 23', to the terminal ends of the cam surfaces integrally having the pin escape positions. If a variation exists in the paper thickness, however, the pins come in and out of the escape positions to take an action corresponding to the vertical movement of the pressure cylinder for automatic adjustment of the pressure of the cylinder 18 to the printing paper. Secondly, if the paper is thick or a uniform print is particularly required, the dial is turned from the AUTO position to proper graduation of 1–6 depending on the paper thickness. When the dial is turned, cam plates 13, 13' move together with the dial as a single body, the pins 15, 15' shift from the terminal ends having the pin escape portion to the other ends in the slots 21, 21' while being elastically pressed to the cam surfaces by means of the springs 23, 23'. Accompanying this shifting action, the arms 27, 27' are rotated about the pins 30, 30' resisting the force of the springs 23, 23', and the pressure cylinder 18 is gradually separated from the rubber roller 17. When the dial is set at any one of the graduations 1–6, the cam shaft 12 stops the rotation thereof while leaving the pins 15, 15' in the slots 21, 21' by the engagement of the positioning wheel 20 with the click 33, and the arms 27, 27' are held to fix the space between the pressure cylinder 18 and the rubber roller 17. Thus, the pressure of the cylinder to the paper is stabilized in desired pressure corresponding preset to the preset graduation of the dial.

What I claim is:

1. A pressure control device for an offset printing machine having a blanket cylinder comprising:

a pair of spaced apart side plates;

a pressure cylinder shaft having eccentric ends extending between said side plates, said shaft being pivotally mounted to said side plates;

a pressure cylinder rotatably mounted on said pressure cylinder shaft and having a periphery engageable with the blanket cylinder;

a cam driven pressure cylinder separating means having one end fixed to one end of said eccentric end to rotate said shaft, thereby changing the distance between said pressure cylinder and the blanket cylinder;

a pair of arms rotatably coupled at their respective ends to respective ones of said eccentric ends, said arms being pivotally mounted to respective ones of said side plates;

a pair of springs biasing respective ends of each of said pair of arms opposite said eccentric ends;

a pair of pins, one of said pair of pins extending transversely from respective ones of each of said pair of arms;

a cam shaft extending between said side plates and rotatably mounted in said side plates;

a pair of cams fixedly mounted on said cam shaft, the respective cam surface of said cams engaging respective ones of said pair of pins;

a dial mounted on one end of said cam shaft indicating the rotational position of said pair of cams;

a serrated wheel mounted on the other end of said cam shaft; and a click mounted to engage the serration in said wheel to position said cam shaft, whereby rotation of said dial causes said pair of pins to move along said cam surfaces, thus pivoting said arm and moving the axial position of said pressure cylinder shaft.

2. The pressure control device as claimed in claim 1, wherein each of said pair of cams have pin escape positions at the ends of said cam surface nearest to said cam shaft, said escape positions permitting said pins to move away from said cam shaft.

3. The pressure control device as claimed in claim 1, wherein each of said pair of cams have pin escape positions at the ends of said cam surface most distant from said cam shaft, said escape positions permitting said pins to move toward said cam shaft.

4. The pressure control device as claimed in claim 3, wherein said dial has position indications including an automatic position indication, and said dial being oriented so that automatic position indication corresponds to said pins being in said escape positions, the maximum position indication on said dial corresponds to said pin being on the end of said cam surface opposite from said escape position.

5. The pressure control device as claimed in claim 1, wherein said pair of cams are each a plate with spiral form cam surfaces.

6. The pressure control device as claimed in claim 5, wherein said spiral form cam surfaces are the walls of a groove formed in said plate.

7. The pressure control device as claimed in claim 5, wherein said spiral form cam surfaces are the sides of elongated openings in said plates.

* * * * *